United States Patent [19]

Brandt

[11] 4,039,081

[45] * Aug. 2, 1977

[54] METHOD AND APPARATUS FOR SIZING AND DISTRIBUTING PRODUCE

[75] Inventor: Vernon J. Brandt, Reedley, Calif.

[73] Assignee: Brandt Manufacturing Company, Inc., Reedley, Calif.

[ * ] Notice: The portion of the term of this patent subsequent to Apr. 9, 1991, has been disclaimed.

[21] Appl. No.: 459,362

[22] Filed: Apr. 9, 1974

Related U.S. Application Data

[63] Continuation of Ser. No. 330,628, Feb. 8, 1973, Pat. No. 3,802,557.

[51] Int. Cl.[2] ..... B07C 5/06

[52] U.S. Cl. ..... 209/73; 209/74 R; 209/105; 198/601

[58] Field of Search ..... 209/73, 74 R, 105, 97, 209/103, 82, 100; 198/81, 103, 139, 187, 159, 601, 585

[56] References Cited

U.S. PATENT DOCUMENTS

| | | | |
|---|---|---|---|
| 194,182 | 8/1877 | Seeber | 198/159 |
| 1,496,376 | 6/1924 | Poore | 209/74 R |
| 3,410,403 | 11/1968 | Adcox | 209/73 |
| 3,638,451 | 2/1972 | Brandt | 209/105 |
| 3,802,557 | 4/1974 | Brandt | 209/73 |

FOREIGN PATENT DOCUMENTS

| | | | |
|---|---|---|---|
| 1,028,638 | 5/1953 | France | 209/103 |

*Primary Examiner*—Robert B. Reeves
*Assistant Examiner*—H. Grant Skaggs
*Attorney, Agent, or Firm*—Lyon & Lyon

[57] ABSTRACT

A method and apparatus for sizing and distributing produce to a plurality of receiving trays. The system includes the employment of a single continuous belt to both feed the produce to a sizer and distribute the sized produce to a plurality of receiving trays. The distribution of the produce from the sizer is through guides which distribute to linearly disposed trays. Both the sizer and the continuous belt are driven from a single power source. The sizer includes a rotating horizontal disk having shoes located peripherally about the disk and spaced to allow selected sizes of produce to fall between the shoes and the disk. A device is provided for either individually or collectively adjusting the height of the shoes with respect to the horizontal disk.

2 Claims, 6 Drawing Figures

METHOD AND APPARATUS FOR SIZING AND DISTRIBUTING PRODUCE

This is a continuation of application Ser. No. 330,628, filed Feb. 8, 1973, and now U.S. Pat. No. 3,802,557.

This invention is directed to a method and apparatus for sizing and distributing produce. More specifically, this invention is directed to a method and apparatus for employing a single continuous belt to both feed a produce sizing machine and distribute sized produced therefrom. Further, a device is provided for allowing both independent and collective adjustment of the shoes located on the sizing machine.

Produce sizing machines employing horizontal circular disks with shoes mounted thereabouts have been employed for separating substantially round produce based on the diameter thereof. These machines have also been employed in combination with belt distributing systems for transporting the sized produce to convenient packing areas. These systems have generally included the use of a plurality of distribution belts extending radially from the sizing machine. One portion of the periphery of the sizing machine was left open for yet another belt to distribute the produce to the rotating horizontal disk from above. Logistically produce handling problems were encountered because of the radial disposition of the distributing belts. Because the packing stations along the belts were not linearly disposed, separate facilities were needed for each belt to supply empty crates, remove full crates, and remove culls. Naturally, such systems resulted in certain inefficiencies and added expenses.

The horizontal disk sizing machines which have heretofore been employed throughout the industry have had individually adjustable shoes. These shoes are set specific distances above the horizontal disk about the periphery of the sizer to separate the produce into several catagories determined by size. The range of sizes normally selected vary with the type of produce being processed through the sizer. When a change is made from one product to another product having a different average size, each individual shoe required raising or lowering depending on the average size of the produce being processed in the systems heretofore employed. This necessarily required a substantial amount of downtime.

The present invention provides a novel system for sizing and distributing produce. The system reduces the complexity of the machinery heretofore employed for sizing and distributing produce and establishes an improved distribution system which feeds receiving trays that are linearly disposed along one side of the machine. Further, the downtime during changes of products has been minimized. Thus, the problems associated with radially disposed distribution systems and separately operated sizing shoes have been minimized.

Accordingly, it is an object of the present invention to provide a sizing and distribution system for produce which distributes sized produce to receiving trays that are linearly disposed near the sizing machine. A belt system is employed which extends from the sizing machine in opposite directions. The belt system is used in combination with a distribution system having a multiple number of guides directing sized produce into two channels for each of the two directions of the belt system and also directly onto some of the linearly disposed receiving trays. Culls are rejected out of the back of the machine and advantageously do not enter the packing area.

A second object of the present invention is to provide a means for leading the sizing machine and distributing the sized produce in two directions through the use of a single continuous belt. The present invention employs a single belt which receives incoming produce and transports it to the sizing machine from one end of the conveyer system. The belt then is directed beneath the sizing machine to provide distribution of the sized produce in a first direction. The belt then returns and continues passed the sizing machine to the opposite end of the system for further distribution of produce in a second direction. The belt is then raised to receive more incoming produce for distribution to the sizing machine.

Another object of the present invention is to provide a distribution system for receiving sized produce from a sizing machine and distributing that produce both directly onto receiving trays and onto a plurality of channels for each of the two directions of the belt system. This distribution system includes a plurality of guides which direct the sized produce from discharge positions about the periphery of the sizing machine to the belt or the trays.

A further object of the present invention is to provide a means for adjusting the shoes associated with the sizing machine both separately and as a unit. The shoes are adjustably mounted on a first member about the horizontal disk. The shoes may be individually adjusted with respect to this member. The member is then adjustably mounted to the frame of the machine. In this manner, the individual shoes may be adjusted or the entire shoe assembly may be adjusted. An overall adjustment of the shoes is required when the type of produce being processed is changed and the average diameter of the two kinds of produce is different. Because of this collective adjustment means, the machine may be altered for different kinds of produce without any significant downtime.

Thus, an improved sizing and distributing system is employed which advantageously distributes sized produce to linearly disposed trays near the sizing machine. Also, a single belt configuration is employed which cooperates with a distribution system including a plurality of guides which feed produce from the sizing machine. Also, the system includes a means for quickly adjusting all of the sizing shoes to accommodate a change in the kind of produce being processed. Further objects and advantages will become apparent from the description herein.

Figure 1:
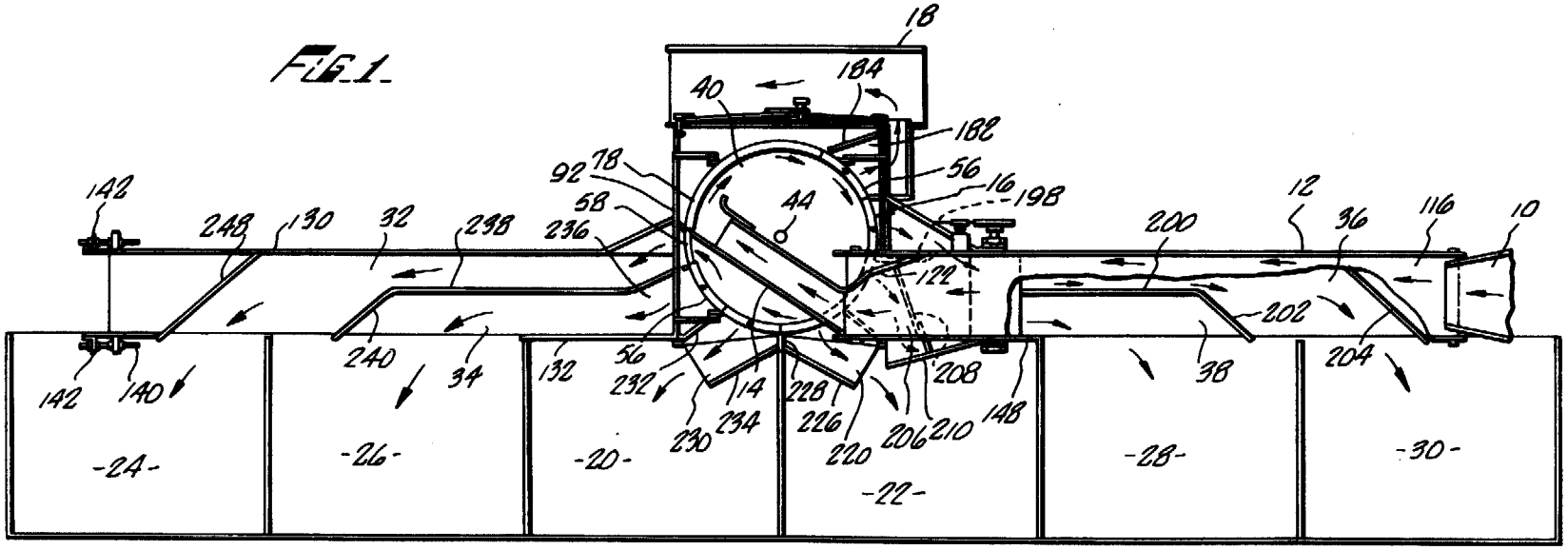
FIG. 1 is a top view of the sizing and distribution system.

Turning now to the drawings, a feeder 10 distributes incoming produce to a feeder channel 12. The produce is then distributed to a chute 14 where it is transferred to a sizing means generally designated 16. From the sizing machine 16, the culls are rejected from the back of the machine to the cull receiver 18 and the produce is sized and distributed directly to the center receiving trays 20 and 22 and to the outer receiving trays 24, 26, 28 and 30 via the four transport paths 32, 34, 36 and 38.

A sizing means 16 is employed to separate the incoming produce according to size. The sized produce is released radially at specific stations about the periphery of the sizing means 16. The device which is employed in this embodiment of size the produce includes a conical disk 40 having a circular base which is rotatably mounted to a frame structure 42. The conical disk 40 is rotatably mounted to the frame structure 42 from below. This avoids any interference with the produce and allows easy access to the sizer. The conical disk 40 is preferably covered with a rubber matting or other resilient material to prevent injury to the produce. Such sizing machines often employ conical disks 40 which have a variable cone angle. In such an instance, sheet metal fingers may be tacked about the outer diameter of the conical disk 40 which extend upward to the center shaft 44. A flat disk is threaded onto shaft 44 and positioned immediately below the sheet metal fingers. The cone angle is then varied by moving the disk up or down on the shaft 44.

The shaft 44 may be driven by a drive wheel 46 which is rotatably mounted relative to the frame structure 42 by shaft 48. Shaft 48 is notched at 50 to allow the drive wheel 46 to be moved in or out beneath the disk 40. Key 52 is positioned through the hub 54 of the shaft 48 to provide positive engagement between the wheel 46 and the shaft 48. The wheel 46 is sized to press against the flat underside of the conical disk 40 and thereby drive the disk 40 off of the shaft 48. The speed of the conical disk 40 may be varied by moving the wheel 46 in either direction along the shaft 48. This allows the speed of the sizing means 16 to be adjustable with respect to the speed of the remainder of the system.

Also included with the sizing means 16 are sizing shoes 56. These sizing shoes 56 are positioned about the periphery of the sizing means 16 on a shoe mounting ring 58. The shoes 56 include an arcuate face 60 and outwardly extending flanges 62 and 64. These flanges 62 and 64 cooperate with a stud 66 positioned through the shoe mounting ring 58 to place the sizing shoes 56. The arcuate face 60 of each shoe 56 has a radius of curvature which is slightly greater than the radius of curvature of the shoe mounting ring 58. Thus, the sizing shoes 56 must be forced outward at their center to contact the shoe mounting ring 58 in order that the studs 66 may be positioned through the flanges 62 and 64. A hole 68 is positioned at the center of each sizing shoe 56 through the upper flange 62. This hole 68 is slightly smaller than the diameter of the body of the stud 66 to prevent the stud 66 from migrating upward with respect to the sizing shoe 56. An extension 70 of the stud 66 is provided with a diameter which will fit through the hole 68. A nut 72 is welded to the extension 70 once the stud 66 is positioned through the shoe 56 and the shoe mounting ring 58. The stud 66 extends downward through a hole in the bottom flange 64 to support the stud 66 along its entire length. The shoe mounting ring 58 is a circular channel member having flanges extending outwardly along the ring. Provision is made for passage of the stud 66 through the flanges of the shoe mounting ring 58. This acts to fix the stud 66 relative to the shoe mounting ring. A threaded block 74 is welded to the upper flange of the shoe mounting ring 58 to fix the stud 66 from moving up or down along its axis through the shoe mounting ring 58. A rubber matting material or other resilient material is employed as a liner 76 on the inner side of the shoe 56 where the produce may be injured by the shoe 56.

Figure 5:
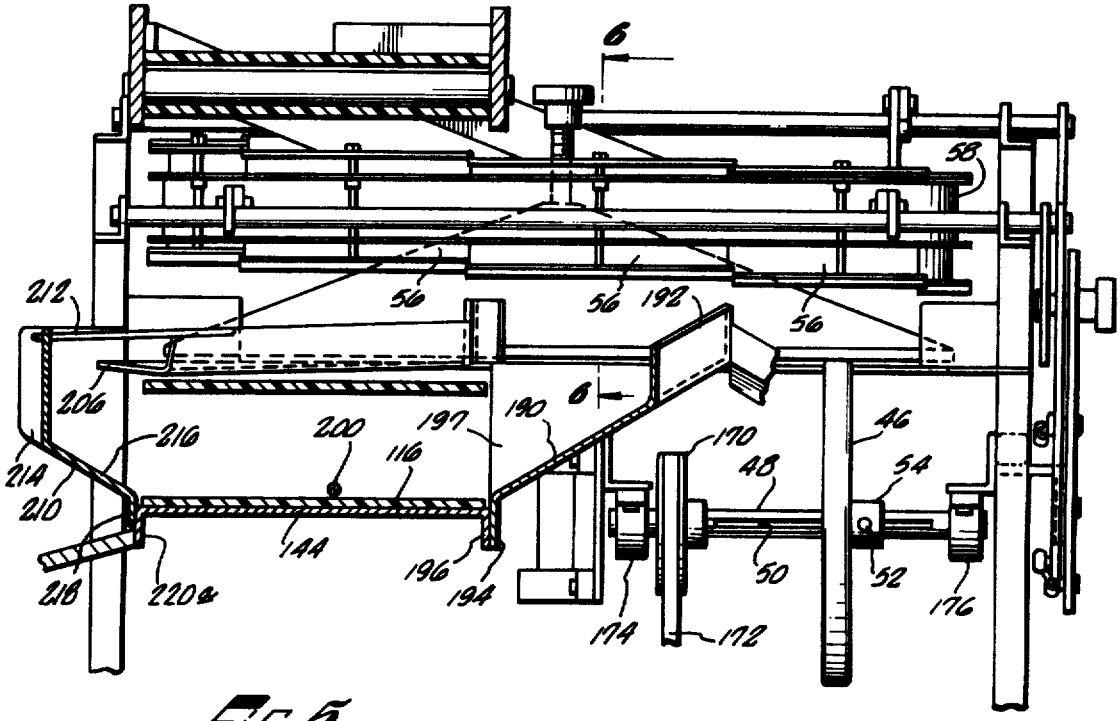
FIG. 5 is a cross-sectional view taken along line 5—5 of FIG. 3 and illustrates the distribution system.
Figure 6:
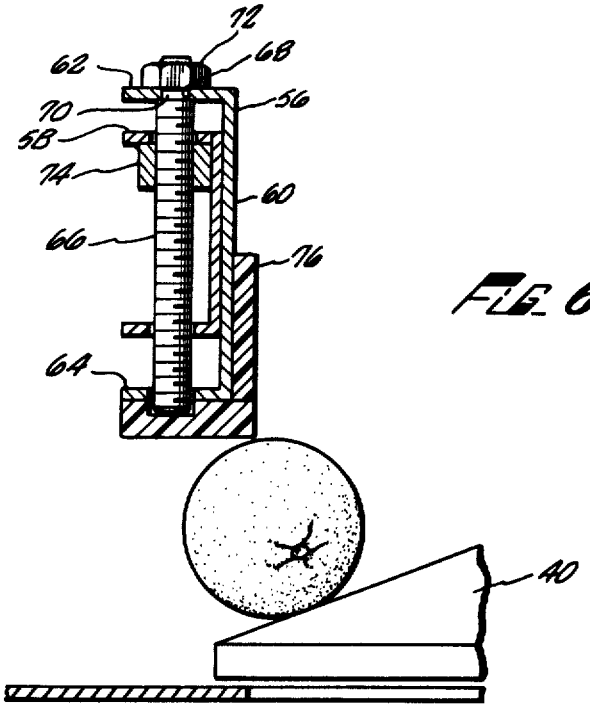
FIG. 6 is a detailed cross-sectional view taken along line 6—6 of FIG. 5 showing the individual shoe adjustment means with some produce passing beneath the shoe.

Six shoes 56 are positioned about the shoe mounting ring 58. Each of the six shoes 56 is positioned at a progressively greater height on the shoe mounting ring 58, as best seen in FIG. 5. The remainder of the shoe mounting ring 58 includes a short length which does not have a shoe 56 thereon. Also, approximately 30% of the shoe mounting ring 58 has a cover 78 which prevents any produce from leaving the sizing means 16.

The sizing means 16 operates by receiving produce from the chute 14. The rotation of the conical disk 40 causes the produce introduced by chute 14 to roll along the cover 78. A wall 80 extending from the end of the chute 14 acts to prevent any produce from rolling in a direction opposite to the rotation of the conical disk 40. A guide member 82 urges the produce into a single layer as it progresses along the cover 78 on the conical disk 40. The produce then rolls into contact with the several shoes 56 positioned about the shoe mounting ring 58. The shoes 56 provide progressively larger openings between the bottom edge of the shoe liner 76 and the top of the conical disk 40 as the produce progresses about the conical disk 40. The various sizes of the produce allow the individual articles to fall between the shoes 56 and the conical disk 40 into the appropriate channel. If the diameter of any individual article is larger than the largest opening provided between the last shoe 56 and the conical disk 40, that article would then pass through the uncovered portion of the shoe mounting ring 58 at the over-size dishcarge port 84. The wall 80 prevents over-sized articles from continuing for a second revolution of the sizing means 16.

In order that the sizing means 16 may be used with a variety of produce, the shoes 56 are adjustable. The shoes 56 are individually adjustable with respect to the shoe mounting ring 58 by means of the studs 66 previously described. A further adjustment means is provided which allows for the simultaneous adjustment of all of the shoes 56. This simultaneous adjustment is made by adjusting the position of the shoe mounting ring 58 with respect to the frame structure 42. This simultaneous adjustment allows for a rapid change in the average space between the shoes 56 and the conical disk 40 to accommodate a change in produce.

This shoe adjustment means may be provided by a linkage system which includes mounts 86 fixed rigidly to the shoe mounting ring 58 at four points. Two vertical links 88 are pivotally mounted to two adjacent mounts 86 on one side of the shoe mounting ring 58. These vertical links 88 are pivotally attached at their upper ends to arms 90 which extend roughly horizontally to a common shaft 92. The arms 90 are fixed to rotate with the common shaft 92. A control arm 94 is also rigidly fixed to the shaft 92 and depends therefrom. The shaft 92 is pivotally mounted to two of the center four legs 96 of the frame structure 42. Thus, the control arm 94 may be pivoted to drive the arms 90 which in turn cause the vertical links 88 to move up and down. A control rod 98 is pinned at one end to the control arm 94 and at the other end to pivoted lever 100 at one of a number of mounting points along the pivoted lever 100.

On the other side of the shoe mounting ring 58, two arms 102 are directly mounted pivotally to the mounts 86. These arms 102 are also rigidly fixed to a common shaft 104 which is pivotally mounted to the other two legs 96 of the frame structure 42. Also, a control arm 106 rigidly depends from the shaft 104 to a control rod 108. The control rod 108 is pinned to the control arm 106 and extends inward to the pivoted lever 100 where it is attached at a point equidistant from the pivot point of the pivoted lever 100 with the first control rod 98. As the pivoted lever 100 is rotated, the shoe mounting ring 58 is caused to move up or down. If the control rods 98 and 108 are not positioned equidistant from the pivoted lever 100, the shoe mounting ring 58 will not be level. The shoe mounting ring 58 may be positioned out of level to give a wider range of selection to the sizing means 16 without individually adjusting the sizing shoes 56. To preserve the setting of the pivoted lever 100, arm 110 may be employed. Arm 110 is pivotally mounted to the shaft 104 and has a slot 112 located therethrough. A fastener 114 may be operated to clamp the pivoted lever 100 and the arm 110 together at a desired position of the pivoted lever 100. This establishes the height of the shoe mounting ring 58 above the conical disk 40.

Means for conveying the produce after it once has entered the system from the feeder 100 until it exits to the receiving trays 20 through 30 are provided by a single continuous belt 116. The belt 116 first receives the unsized produce at the feeder 10 and conveys it along the feeder channel 12 to the chute 14. The belt 116 is supported along the feeder channel 12 by a flat sheet 118 having sides 120 which guide the belt 116 and prevent the produce from rolling off the belt. A guide 122 causes the incoming produce being transported on the belt 116 along the feeder channel 12 to funnel toward the chute 14 where it then rolls by gravity to the conical disk 40. The chute 14 is positioned sufficiently close to the belt 116 that produce cannot drop therebetween. The feeder channel 12 provides an advantageous position for visually grading the produce before it enters the sizer means 16. Inspectors may stand on the side of the device opposite the trays to remove the substandard produce. The belt then continues about roller 124 which is rotatably mounted between the sides 120 of the feeder channel 12. The belt 116 then is passed over drive roller 126 and proceeds horizontally to form transport paths 32 and 34. A side member 130 prevents produce from rolling from the transport path 32. The side member 130 is fixed to the flat sheet 128 which is in turn supported on the various legs of the device. A second side member 132 is positioned along the transport path 34 and is also fixed to the flat sheet 128. This second side member 132 extends to the boundary between receiving trays 20 and 26 to prevent produce on transport path 34 from entering the receiving tray 20. The side member 132 is formed from a rod in the preferred embodiment. The belt 116 then continues around an adjustable roller 134 and is directed back toward the center of the system. The adjustable roller 134 is positioned at either end thereof in slots 136. One slot 136 is positioned in plate 138. The second slot is positioned in the side member 130. A tension rod 140 is positioned through each end of the adjustable roller 134. The tension rods 140 also extend through brackets 142 where they are held by nuts. The tension in the belt 116 may be controlled by adjusting the nuts on the tension rod 140.

The belt 116 continues from the adjustable roller 134 to the transport paths 36 and 38. A cover 143 is provided from the adjustable roller end of the device to the center legs 96 to prevent produce from getting into the belt area. A third flat sheet 144 supports the belt 116 along the transport paths 36 and 38. A side member 146 extends along the side of the transport path 36 to the end of the structure. Another side member 148 extends along the outside of the transport path 38 to the junction between the receiving trays 22 and 28. This prevents produce traveling along the transport path 38 from falling into the receiving tray 22. The belt then continues around roller 150 and is directed upward to roller 152 where it again runs along the flat sheet 118 at feeder channel 12. The rollers 150 and 152 are positioned in end plates 154. Ends plates 154 are attached to the sides 120 and side 146 for added rigidity. Two legs 156 extend to the floor for support of the system. Similar legs 158 support the other end of the system.

A drive means is provided by motor 160. The motor is mounted to the frame structure 42 on cross-member 162. The drive roller 26 is driven by motor 160 through drive belt 164. Drive belt 164 extends from the motor 60 to a pulley 166 on the drive roller 126. An idler roller 168 provides tension on the drive belt 164. The drive wheel 46 of the conical disk 40 is also powered by the motor 160. A pulley 170 is keyed to shaft 48. The motor drives the pulley 170 through drive belt 172. The shaft 48 is held in position by bearings 174 and 176 which are mounted to the frame structure 42. The drive roller 126 is mounted in bearings 178 which are rigidly fixed to vertical support members 180. Thus, one drive means may be employed to drive both the sizing means 16 and the belt 116.

To properly direct the sized produce from the sizing means 16 to either the transport paths 32 through 38 or directly to the center receiving trays 20 and 22, distributing means must be provided. The distributing means may consist of a plurality of guide channels which are sloped from the sizing means 16. Each guide channel receives the produce from a single sizing shoe 56. The first guide channel 182 is positioned exterior to the sizing means 16 adjacent the first sizing shoe 56. The first sizing shoe 56 is positioned with respect to the conical disk 40 so that only rejected produce or culls will pass into the first guide channel 182. The first guide channel 182 has side walls 184 and 186 which direct the culls along the first guide channel 182 to the sloping channel 188 where the culls are then directed to the cull receiver 18. The cull receiver 18 is advantageously placed at the back of the unit to keep it separated from the accepted produce.

A second guide channel 190 is positioned at the periphery of the sizing means 16 and extends down to the transport path 36. The guide channel 190 is positioned beneath the second sizing shoe 56 at the sizing means 16 to receive the smallest acceptable produce. The second guide channel 190 includes a sidewall 192 which extends along the upper edge of the guide channel 190 along a path away from the sizing means 16. The second guide channel 190 extends from the sidewall 192 downward at an angle to a lower horizontal edge adjacent the transport path 36. At this lower horizontal edge of the second guide channel 190, a flange 194 vertically extends adjacent a down turned flange 196 on the third flat sheet 144. The sized produce which exits beneath this second shoe 56 on to the second guide channel 190 are urged outward from the conical disk 40 by the rotation thereof. The produce then rolls down the guide channel 190 to the belt 116 at at transport path 36. The upper sidewall 192 and the guide channel 190 extend to a vertical edge depending from the side 120 of the feeder channel 12. This prevents produce from rolling off the edge of the guide channel 190 before reaching the transport path 36. A back plate 197 is shown positioned vertically from the horizontal frame plate 224 located beneath the conical member 16 to the guide channel 190 to keep the produce from exiting back into the machinery. A guide 198 extends outwardly from the sizing means 16 and is curved at its extended end to urge the sized produce traveling into the guide channel 190 away from the belt 116 as it travels in the opposite direction above the transport path 36. A rod 200 extends above the belt 116 parallel to the transport path 36 to define one edge thereof. The rod 200 is bent at 202 toward the edge of the belt 116. A small vertical section of the rod 200 extends down the angled portion of the rod 202 to attach to the third flat sheet 144 for support. The other end of the rod 200 extends laterally across the top of the belt 116 to attach to the edge of the back plate 197. A second rod 204 extends diagonally across the belt 116 to define the end of the transport path 36. The rod 204 is attached at one end to the side member 146 and at the other end extends downward to attach to the third flat sheet 144. The produce distributed by means of the second guide channel 190 to the belt 116 at the transport path 36 will ride on the belt 116 until they encounter the rod 204. The rod 204 causes the produce to migrate across the belt 116 to the receiving tray 30.

A third guide channel 206 is positioned adjacent the sizing means 16 beneath the third sizing shoe 56 to receive the produce discharged therefrom. This third guide channel 206 includes a sidewall 208 which acts to channel the articles along the third guide channel 206. The guide channel 206 extends across the belt 116 at a point along the belt where it is traveling in the opposite direction to the direction of travel along transport path 38. The sized produce is thus transported across the top of belt 116 and dropped into guide 210. The produce is urged outward on to the third guide channel 206 and is caused thereby to roll into guide 210. The third guide channel 206 is supported at its outer end by a rigid rod 212 which is fixed at one end to the third guide channel 206 and at the other end to the guide 210. The guide 210 includes a vertical side wall 214 which directs the produce dropping from the third guide channel 206 downward onto an angled portion 216 of the guide 210. The angled portion 216 of the guide 210 directs the falling produce inwardly onto the belt 116 at the transport path 38. The vertical sidewall 214 is angled with respect to the transport path 38 to a vertical edge which is directly adjacent the transport path 38. The angle on the vertical sidewall 214 prevents the produce from falling out of the guide 210 before it reaches the transport path 38. A vertical flange 218 extends from the bottom edge of the angled portion 216 of the guide 210 for attachment to a depending flange 220 of the third flat sheet 144. The produce then is transported along transport path 38 to the receiving tray 28. The wire 202 acts to separate the transport paths 36 and 38 and causes the produce to migrate to the receiving tray 28 at the angled portion of the rod 202. The outside wall of the transport path 38 is provided by the vertical support member 180 and the side member 148.

Figure 2:
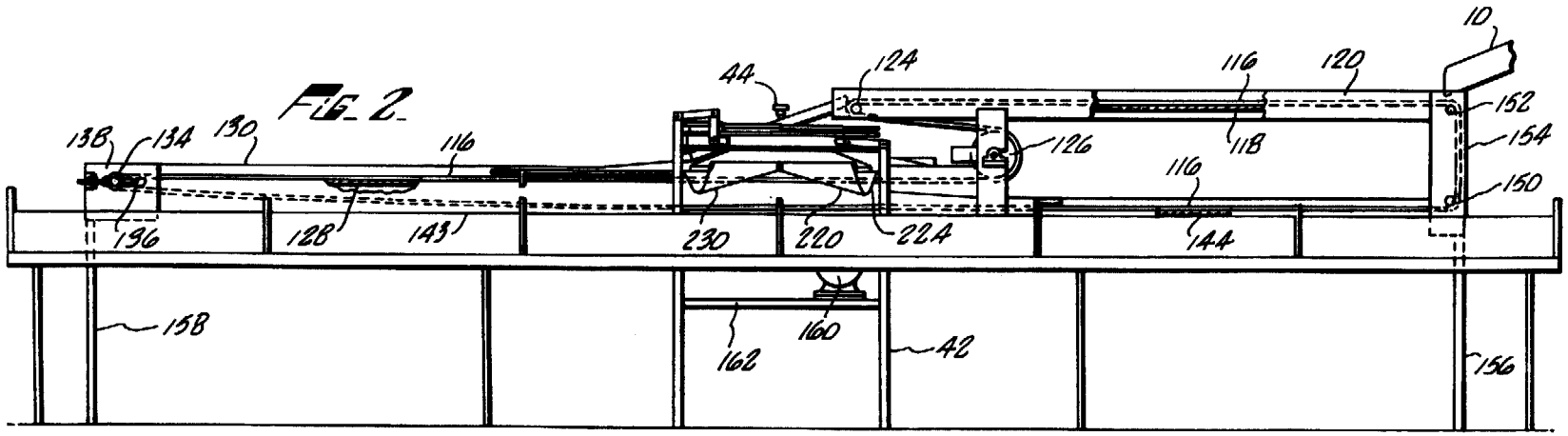
FIG. 2 is a front view of the sizing and distribution system.
Figure 3:
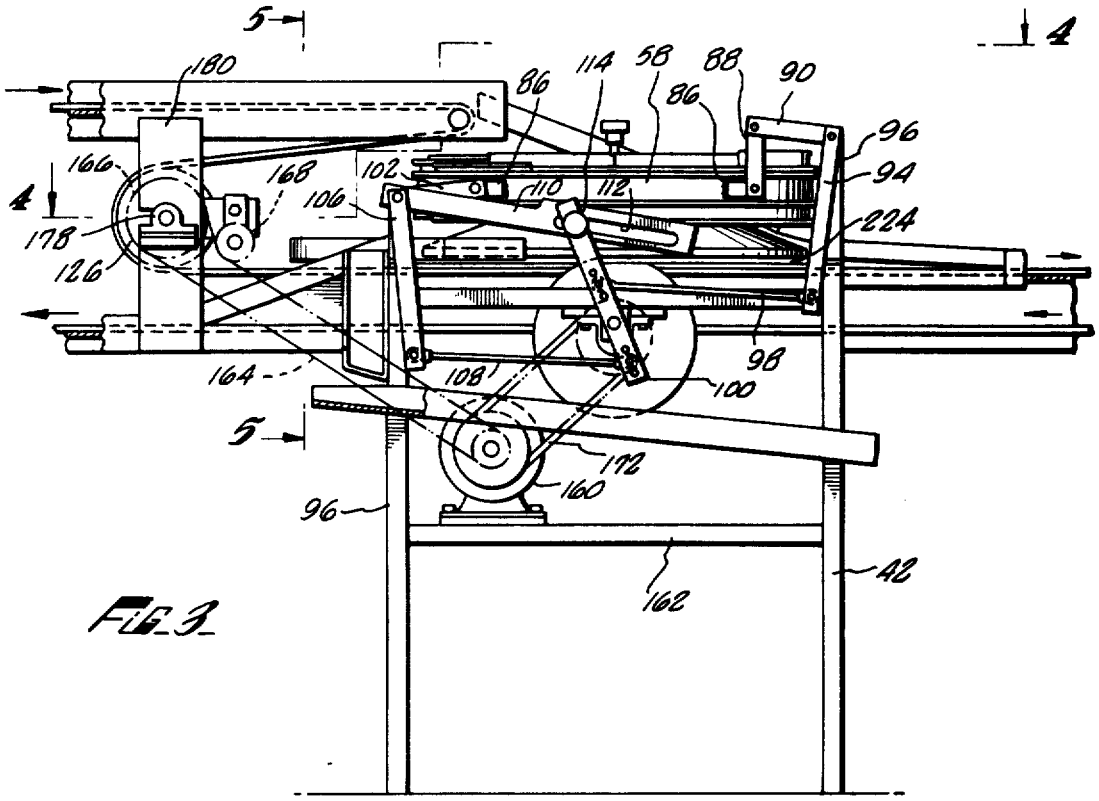
FIG. 3 is a detail of the back of the sizing system illustrating the raising and lowering mechanism for the sizing shoes. The center portion of the belt system is also illustrated.
Figure 4:
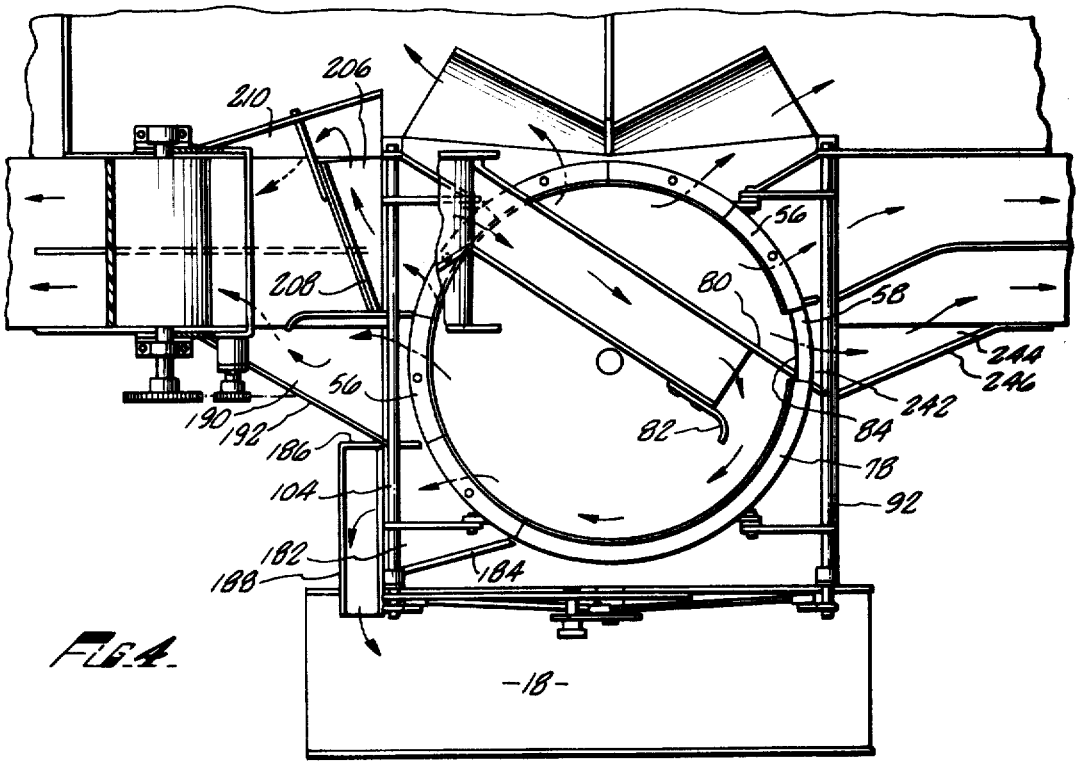
FIG. 4 is a cross-sectional view taken along line 4—4 of FIG. 3 illustrating the distribution system and the sizing machine.

A fourth guide channel 220 is positioned adjacent the sizing means 16 beneath the fourth sizing shoe 56. The fourth guide channel 220 may be of a flexible material as indicated in FIG. 2. The first edge 22 of the flexible guide channel 220 is attached at the plate 224 which extends from under the conical disk 40. A rod 226 extends outward from the sizing means 16 in a horizontal plane which is slightly above the bottom edge of the conical disk 40. By placing the rod 226 above the bottom edge of the conical disk 40, produce is prevented from jumping out of the fourth guide channel 220. The fourth guide channel 220 is suspended from the rod 226 and is attached at the other side to the plate 224. The fourth guide channel 220 is wider at its outward edge in order that the bottom of the fourth guide channel 220 will slope downwardly from the sizing means 16 when put in position. The rod 226 is fixed to the plate 224 of the frame structure 42 by a vertically extending plate 228. The produce passing from the sizing means 16 underneath the fourth sizing shoe 56 onto the fourth guide channel 220 is directed along the guide channel 220 to the receiving pan 22.

A fifth guide channel 230 is positioned adjacent the sizing means 16 beneath the fifth sizing shoe 56 to receive produce dispensed therefrom. The fifth guide channel 230 is identical to the fourth guide channel 220 but is reversed. The fifth guide channel 230 is fixed along one side 232 to the plate 224. A rod 234 extends from the vertically extending plate 228 in the same horizontal plane as rod 226. The fifth guide channel 230 empties the produce received from the sizing means 16 onto the receiving pan 20.

A sixth guide channel 236 is positioned adjacent the sizing means 16 beneath the sixth sizing shoe 56. This sixth guide channel 236 is formed as a portion of the plate 224. The outer side of the sixth guide channel 236 is formed by the rod 232. A second rod 132 is attached to the plate 224 and extends along the transport path 34 to the first edge of the receiving pan 26. A vertical portion of the rod 132 extends to the second flat sheet 128 and is fixed thereto. The rod 132 prevents the produce being transported along path 34 from entering the receiving tray 20. An inner boundary of the transport path 34 and the sixth guide channel 236 is formed by rod 238. Rod 238 is attached at its inner end to plate 224 beneath the trailing edge of the sixth sizing shoe 56. The rod 238 then extends to the center of the belt 116 defining transport paths 34 and 32 where it then runs down the center of the belt 116 to an angled portion 240. At the end of the angled portion 240 a vertical section extends downward and is fixed to the second flat sheet 128. Thus, the transport path 34 is defined by the rod 132 and the rod 238. The produce which is deposited onto the belt 116 in transport path 34 is moved to the angled portion 240 of the rod 238 where it is then forced into the receiving pan 26.

A seventh guide channel 242 is positioned adjacent the sizing means 16 beneath the portion of the shoe mounting ring 58 which does not have a sizing shoe positioned thereon. The seventh guide channel 242 is formed by the plate 224, the rod 238, a guide plate 224 and a side plate 246. The guide plate 244 is triangularly shaped with one side abutting the plate 244, one side abutting the second flat sheet 128 and a third side extending beneath the side plate 246. The side plate 246 extends from the chute wall 80 to the side member 130 of the second flat sheet 128. The transport path 32 is defined by the rod 238 and the side member 130. A rod 148 extends from the side member 130 to the plate 138. Produce traveling down the transport path 32 encounters the rod 248 and is swept into the receiving tray 24. All of the produce which was not distributed under any of the sizing shoes 56 will be forced to exit through the seventh guide channel 242 by the extending wall 80 of the chute 14.

To summarize the overall operation of the machine, the motor 160 drives the conical disk 40 through drive wheel 46. The motor 160 also drives a single continuous belt 116 through the drive roller 126. The single continuous belt 116 receives produce from the feeder 10 and directs it onto the conical disk 40 through chute 14. Sizing shoes 56 are positioned above the conical disk 40 above the periphery of the disk. These shoes 56 are positioned at varying heights to present several passage ways from the conical disk 40 having openings of varying heights. The produce is driven about the disk 40 until it reaches a shoe 56 under which it can pass. As it passes from the disk 40, each article will enter one of several guide channels. A first guide channel 182 directs undersized produce to a cull receiver 18. The second guide channel 190 and the third guide channel 206 direct produce onto the belt 116 at transport paths 36 and 38 respectively. The produce is then distributed to its respective receiving trays. The fourth guide channel 220 and the fifth guide channel 230 exhaust directly into the respective receiving trays. The sixth guide channel 236 and the seventh guide channel 242 exit onto the belt 116 at transport paths 32 and 34. The produce is then transported by the belt 116 along transport paths 32 and 34 until it is forced to enter the receiving trays 24 and 26 respectively.

Thus, an improved sizing and distributing system is disclosed which employs a single belt for both introducing unsized produce along an inspection station and distributing sized produce in opposite directions from a sizing device. Further, both the sizing device and the transport belt are driven by the same driven means for further simplification. A means is also provided for quickly adjusting the sizing device to accommodate a change in the average size of the articles being processed through the sizing and distributing machine. The articles which have been sized are then distributed through the use of the belt to receiving trays which are set up in a straight line to facilitate the packing operation. While embodiments and applications of the invention have been shown and described, it would be apparent to those skilled in the art that many more modifications are possible without departing from the inventive concepts herein described. The invention, therefore, is not to be restricted except as is necessary by the prior art and by the spirit of the appended claims.

I claim:

1. A device for separating and distributing produce of dissimilar size, comprising sizing means for receiving produce of dissimilar size from above and distributing that produce downwardly in a plurality of paths according to size;

a single continuous transport means for transporting sized produce in two transport directions from said sizing means for subsequent distribution from said transport means and for transporting unsized produce to said sizing means, said transport means comprising a continuous conveyor belt defining at least three paths, a first path for transporting produce to said sizing means and distributing said produce downwardly into said sizing means, a second path below said sizing means for receiving sized produce from said sizing means and transporting same in the one direction and a third path below said sizing means for receiving sized produce from said sizing means and transporting same in the other direction.

2. The device of claim 1 wherein said first, second and third paths each lie in horizontal planes, said sizing means being positioned between the horizontal plane of said first path and the horizontal planes of second and third paths.

* * * * *